United States Patent [19]

Lawson

[11] Patent Number: 4,942,683

[45] Date of Patent: Jul. 24, 1990

[54] SHIRT LETTERING AND ILLUSTRATING FORM

[76] Inventor: Darl Lawson, 4630 Chrome Ridge Ct., Placerville, Calif. 95667

[21] Appl. No.: 401,104

[22] Filed: Aug. 31, 1989

[51] Int. Cl.[5] ..... D06C 3/08; A41H 5/00

[52] U.S. Cl. ..... 38/102.91; 223/69; 223/71

[58] Field of Search ..... 38/102.1, 102.91; 160/378; 248/453; 223/52, 66, 69, 71, 84, 87; D6/326

[56] References Cited

U.S. PATENT DOCUMENTS

| | | | |
|---|---|---|---|
| 886,795 | 5/1908 | Goodman | 223/71 |
| 1,249,411 | 2/1917 | Joseph . | |
| 1,789,909 | 1/1931 | Raffelson | 223/71 |
| 2,559,096 | 3/1951 | Tomarin | 223/85 |
| 2,615,602 | 11/1952 | Thompson et al. | 223/87 |
| 3,205,614 | 7/1965 | Brosk . | |
| 3,391,635 | 6/1968 | Matheus . | |
| 3,958,508 | 3/1976 | Sakurai | 101/407 BP |
| 3,992,988 | 2/1976 | Dwyer | 101/9 |

FOREIGN PATENT DOCUMENTS

| | | | |
|---|---|---|---|
| 1366208 | 6/1964 | France | 223/69 |
| 1011426 | 12/1965 | United Kingdom | 223/69 |

*Primary Examiner*—Werner H. Schroeder
*Assistant Examiner*—David K. Suto
*Attorney, Agent, or Firm*—Joseph E. Gerber

[57] ABSTRACT

A form for lettering and illustrating shirts is disclosed, said form being a stiff, generally rectangular sheet with a handle projecting from its upper edge, arm tabs projecting outward from its upper side edges, and clips disposed along its lower edge for holding a shirt flat on the form. The clips employed have a fixed portion bound to the form's face and a pivoting portion biased against said face. The clips also include an extensible lever on their pivoting portion. A notch is provided beneath one of the form's arm tabs to relieve stress upon shirt' underarm seams.

30 Claims, 2 Drawing Sheets

FIG.-1
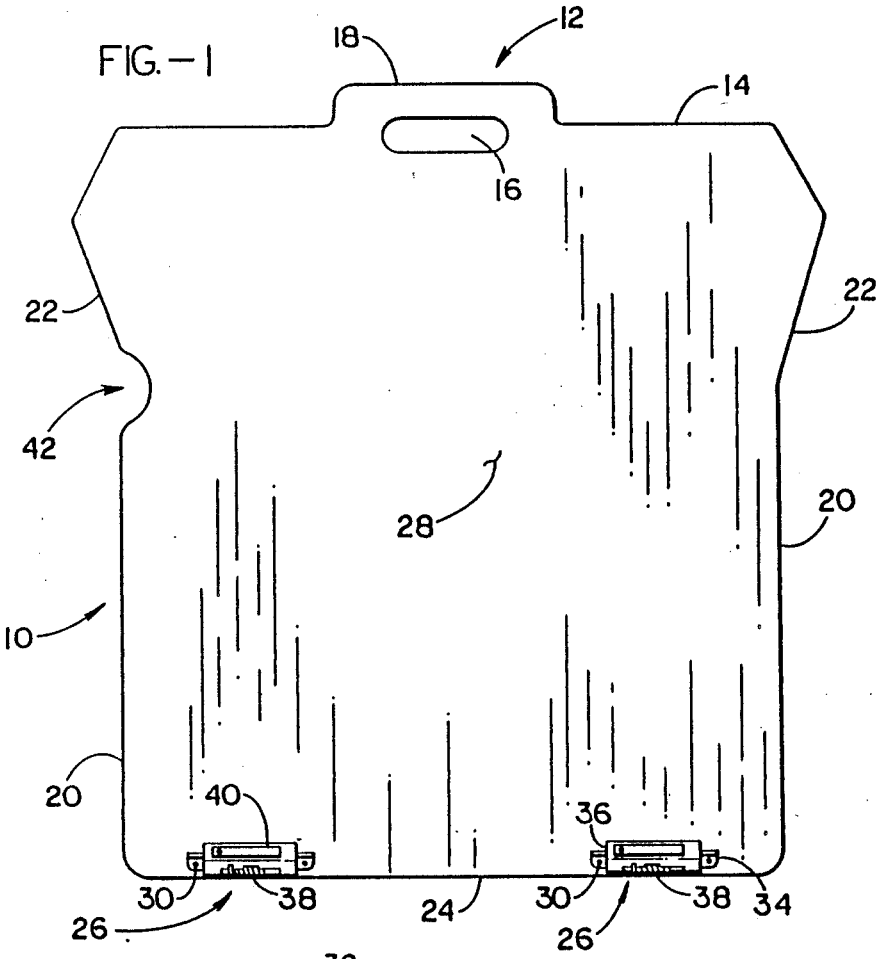
FIG.-2
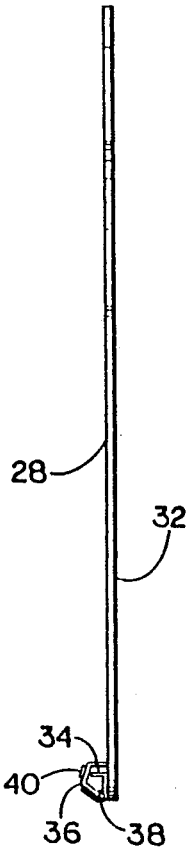
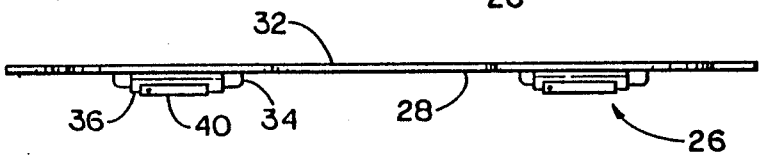
FIG.-3
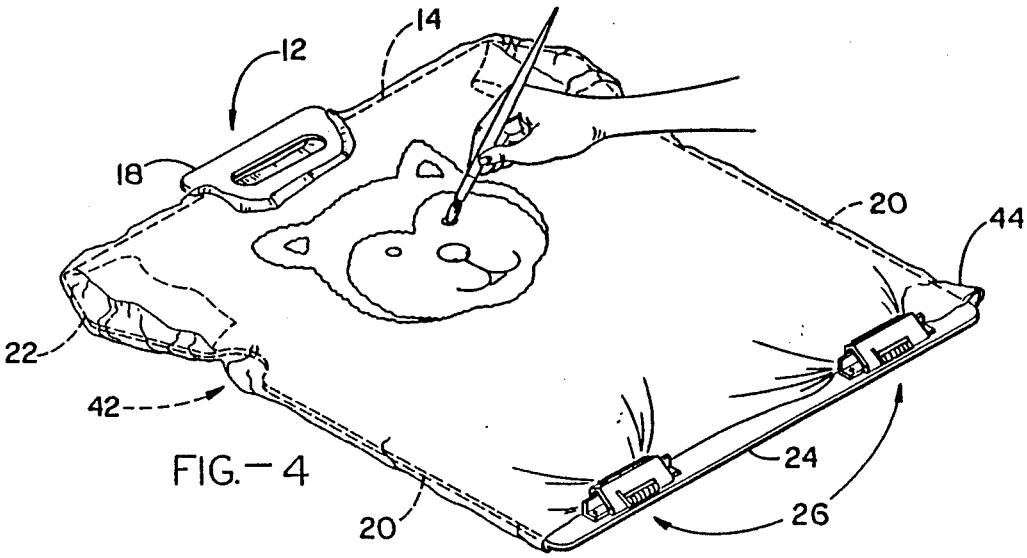
FIG.-4

SHIRT LETTERING AND ILLUSTRATING FORM

BACKGROUND OF THE INVENTION

1. Field of the Invention

The present invention relates generally to forms for supporting garments, and more specifically to forms for holding shirts flat while applying letters or illustrations.

2. Description of the Related Art

For some time now, lettered and illustrated clothing has been in vogue. Whether rendered with ink, paint, iron-on or other fusible decalcomanias, quality results demand that the clothing's fabric be held flat and slightly taut during application.

The simplest method of keeping a shirt flat and taut is to wrap it over a hard-surfaced, rectangular board and then to lay the board on a flat surface to keep the shirt in place while applying letters or illustrations. When using such media as paint and ink which are likely to soak through fabric, the board may be slipped inside the shirt to prevent damage to its second layer. These methods are unstable in that the shirt may wrinkle or shift during application, and it is difficult to determine whether the lettering or illustration is properly centered until application is complete. Despite these drawbacks, amateurs and commercial operations alike continue to use this approach.

Sometimes, after a shirt is wrapped around a board, spring-biased clips are applied to the board's edges to keep the shirt in place more securely. However, once bound in place, most conventional clips have half their hardware projecting below the surface of the board. This makes it awkward to lay the board down for work on a flat surface. For example, the board may rock unstably; and, if one leans on the board, the downward pressure may release the clips. Further, clip hardware projecting outward from the edges of the board makes it difficult to stand the board upright upon its clipped edges. Therefore, work upon an easel, or the like, may be hindered.

A cardboard form in the exact, angular shape of a T-shirt has also been used for shirt lettering and illustrating. However, the task of getting this form properly situated inside a shirt is so awkward and time-consuming as to make its use by anyone other than an amateur inefficient. Further, unless dimensioned for each shirt size, small shirts must be stretched to fit the form and large shirts must be taped or clipped in place to be held flat. And, cardboard lacks the rigidity needed in a form intended for repeated use. Finally, cardboard is less desireable for use with a hot iron than more substantial materials.

Some commercial operations, particularly silk-screeners, spread a shirt flat and then drop a frame over it, bordering the area where the application is to be made. This is more or less effective in avoiding wrinkles and preventing shifting, however such equipment may be somewhat more complicated, fragile and expensive than desired. And, in addition, a frame may make it a little more difficult to center the application precisely on the shirt.

For iron fusible transfers, and the like, centering the application on a shirt by hand is particularly difficult; a conventional ironing board permits approximate placement, at best. And, the methods discussed above are not particularly adapted to ironing.

Most importantly, no presently available apparatus addresses the specific needs of those artists who create original works on shirts, and those working in hybrid media such as with iron fusible transfers along with which paint or ink are applied with air brushes, bristle brushes or other instruments. Here, it is desirable that the shirt remain on a single stable form throughout the operation; in fact, this is essential for best results. Further, such a form with its bound shirt should be equally stable whether placed flat upon a table, upon the artist's lap or upon an easel for upright work.

Thus, a need exists for a shirt form that is simple and inexpensive, yet effective in preventing wrinkles and shifting during application. It would be particularly suited to the needs of the shirt artist doing some part of the work in freehand producing original, and semi original works. The ideal form would also permit accurate placement of the application on the center of the shirt. And, if possible, a broad range of sizes should be accommodated by a single form.

SUMMARY OF THE INVENTION

The shirt form of the present invention is adapted to address the above-noted shortcomings of the related art, and to fulfill the stated needs. It is comprised of a stiff, generally rectangular sheet, the upper edge of which has a handle. A pair of arm tabs project from the upper end of each of the side edges near the handle edge, and means are provided on the lower end of the sheet for retaining a shirt in a taut posture thereover.

Thus, the form is generally torso-shaped, the handle at the top resembling a neck, and the arm tabs projecting from the form's lateral edges just far enough into the shoulder area of the shirt to provide support for lettering and illustration there. Clips are the preferred means for holding the shirt flat. In addition, extensible means may be bound to the clips for increasing the leverage available for opening them, these means also being retractable to a position within the perimeter of the form. A shirt slipped over the form assumes a natural, yet planar, shape and when clipped in place with the desired tension it can be lettered and illustrated with great facility.

To accommodate a broader range of sizes, one embodiment of the inventive shirt form includes a means such as a notch under one arm tab, i.e. just below the shoulder support area. This feature permits relief for a shirt's underarm seam, which is characteristically a minimally resilient structure prone to tearing when over-stretched.

Thus, it is an object of the present invention to provide a form able to retain a shirt in a secure, slightly taut posture without obstructing the shirt's surface.

It is a further object of the present invention to provide a form suiting the particular needs of the shirt artist who renders original and semi-original works.

It is a feature of the present invention to provide a shirt form shaped as a torso to minimize wrinkling and to permit easy centering of the application.

It is a further feature of the present invention to provide retaining means on said form adapted to easy adjustment of the shirt fabric's tension.

It is yet an additional feature of the present invention to provide a shirt form having means for relieving the stress on the underarm seams of a shirt, thereby enabling the form to accommodate a broader range of shirt sizes.

And, still a further feature of the present invention is to provide a form with shirt retaining means that do not project below the form's rear face, nor beyond the form's lower periphery.

It is an advantage of the present invention to provide a shirt form able, once a shirt is in place, to be used either on a flat surface, on the artist's lap or propped up upon an easel.

It is a further advantage of the present invention to provide a simple and inexpensive shirt form able to yield superior results for the purposes of lettering and illustrating shirts.

Still further objects, features and advantages of the inventive shirt form disclosed herein will be apparent from the drawings and following detailed description thereof.

BRIEF DESCRIPTION OF THE DRAWINGS

FIG. 1 is a front elevation of the inventive shirt form.

FIG. 2 is a side elevation of the shirt form of FIG. 1, showing said form's left edge.

FIG. 3 is a top view of the shirt form of FIG. 1.

FIG. 4 is a perspective view of the inventive form with a shirt slipped thereover, illustrating its intended manner of use.

DESCRIPTION OF THE PREFERRED EMBODIMENT

Figure 5:
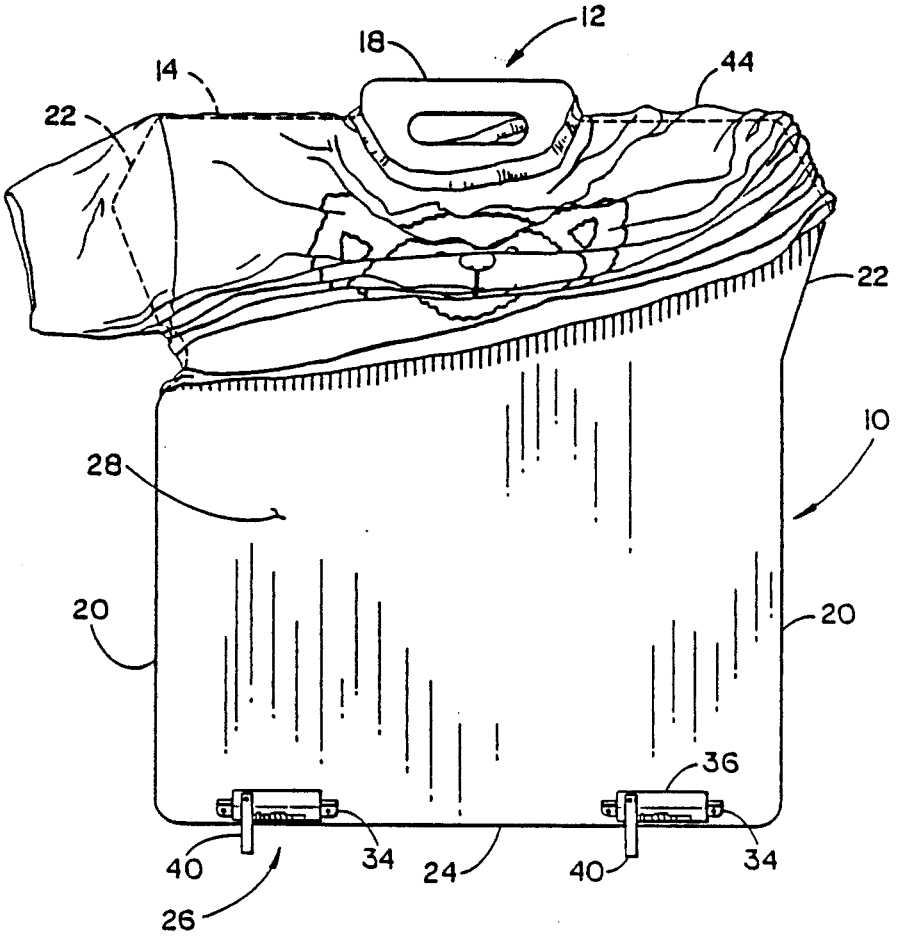
FIG. 5 is a front elevational view of the shirt form herein with a shirt partially removed, particularly illustrating the manner in which the notch in the form's edge relieves stress on the shirt's underarm seams.

Referring now specifically to the drawings, FIGS. 1, 2 and 3 show the inventive shirt generally identified herein by reference numeral 10. Form 10 comprises a stiff, planar sheet and is preferably constructed of fiberboard although composition board, plywood or similar materials may also perform well. It is desirable that said sheet be heat resistant, as form 10 is intended for use with iron fusible transfers as well as paint, ink and the like.

As shown in front elevation in FIG. 1, form 10 has an upward projection 12 from the center of its upper edge 14 resembling a neck. A horizontal slot 16 is disposed in neck projection 12, defining a handle 18.

At the upper extremes of side edges 20, just below upper edge 14, a pair of arm tabs 22 project outward from the form. Arm tabs 22 correspond to a shirt's shoulder and upper arm area. They are mildly angular with their apices directed outward from the form's longitudinal side edges. Each has chamfered corners and projects a short way into a shirt's upper sleeve cavity to provide support for lettering and illustrating. However, their unique shape also permits a shirt to slide over them very easily.

The lower edge 24 of form 10 is parallel to upper edge 14, and bears a pair of clips 26 for grasping a shirt's lower hem. Clips 26 are mounted on the front face 28 of the form, and are flush along lower edge 24. The jaws of clips 26 open inward with respect to the form; that is, they are oriented to grasp the lower hem of a shirt as it is pulled down over the form. Clips 26 may be mounted using any fastening means, for example, rivets 30 are adequate. It is important that no hardware, neither clips 26, nor the clip fastening means employed, project substantially beyond the plane of form 10's rear face 32. This assures that form 10 is able to be laid flush upon a flat working surface for maximum stability while letters or illustrations are being applied. In addition, this arrangement prevents interference with the clips' binding mechanisms because they reside wholly upon front face 28 of the form.

As shown in FIG. 2, clips 26 have a fixed portion 34 mounted to the form and a pivoting portion 36 biased by spring 38 against form 10's front face 28. Further, a lever 40 on each clip swings, from a single bound point, outward from said clip for better leverage against the clip's spring as illustrated in FIG. 5.

This preferred clip design and placement is advantageous in several ways. When lever 40 is folded in, it allows the form to be stood upright upon its lower edge, or set upon an easel, without any clip hardware getting in the way. And, when a clip's lever is swung to the outward position, it permits the heel of the hand to be used in depressing lever 34 while grasping against rear face 32 with the fingers. This makes it possible to use a heavier, stronger clip in a given amount of surface area, thereby maximizing the useful space on the form's front face 28.

Thus, the inventive form disclosed may be employed as in FIG. 4 to hold a shirt flat while an illustration, for example, is being applied.

Slipping a shirt such as a T-shirt or sweat shirt over form 10 and removing it is sometimes difficult if the shirt happens to be of a smaller size. Although most of a conventional shirt's fabric seems able to tolerate considerable stretching without failure, the limiting factor appears to be that the seams running under a shirt's arms are prone to tear when more than minimally stretched. That is, if a small shirt is stretched over a larger form the fabric may be tolerant, but the underarm seams may not. Of course, it is possible to use a different sized form for each shirt size; however, this may in some cases be impractical.

To remedy the above problem, and to provide an advantageous modification to the above-disclosed inventive shirt form, a cutout or notch 42 is provided just under one of arm tabs 22 as shown in FIG. 1. This yields two advantages. First, shirt 44, even if somewhat small, may be slipped over form 10 with greater ease if the fabric of one side of its torso, up to its underarm seam, is first bunched up into the notch, and then the rest of the shirt is drawn up over neck projection 12 and down over the opposite arm tab. This is best illustrated in FIG. 5. Thus, notch 42 prevents the underarm seam from being unduly stretched during this operation, as well as when the shirt is being slipped off the form.

Second, notch 42 prevents the shirt's underarm seam from being under continued stress while illustrations or letters are being applied. Gradual stretching of the underarm seam is, in this way, prevented. Further, it is observed that only one notch is necessary to yield the desired results, although it is not expected to be detrimental to provide one under each arm tab. And of course, to a degree corresponding to the resilience of shirt fabric, the larger the notch, the more shirt sizes that can be accommodated with a single form.

In use, if a shirt of ample size is to be lettered or illustrated, it is simply slipped over the inventive shirt form and pulled down so its neck hole seats over the form's neck projection 12. The shirt's shoulders should seat upon the form's upper edge 14, its arms should receive arm tabs 22 and its lower hem should be drawn down to the vicinity of clips 26. Levers 40 may then be swung outward and depressed to open the clips' jaws. The lower hem of the shirt is then bound into the clips so its fabric is flat and smooth on the form's front face 28. Form 10 may then be grasped by its handle and moved around as desired without disturbing the shirt's surface.

Illustrations or letters may be applied with equal facility whether the form is laid flat, stood up upon its lower edge or propped upon an easel. For example, a pattern or letters may be applied by ironing a fusible transfer to the shirt with the form laid stably upon a table top. Once complete, the form may be grasped by its handle and set aside to cool. Once cool, it may be laid upon one's lap or propped upon an easel for application of paint or ink. Following this, the form may again be set aside, this time to dry. During this process, it is unnecessary to remove or otherwise disturb the shirt on the form. And, since the whole face of the shirt is pulled flat and in proportion, it is a simple matter to center the lettering or illustration desired.

If, perhaps, the shirt to which the application is to be made is somewhat small, it is slipped onto the form as described above, i.e. first one side is bunched into the notch beneath an arm tab, then the rest of the shirt is drawn over the form from there. Such a shirt is removed merely by reversing this procedure.

The foregoing detailed disclosure of the inventive shirt form 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive form may later be realized. Accordingly, the scope of the invention should be determined with reference to the appended claims, and not by the examples which have herein been given.

I claim:

1. A form for lettering and illustrating shirts comprising, in combination:

a. a stiff, generally rectangular sheet, one edge of said sheet having a handle;

b. an arm tab projecting from each of two edges perpendicular to said edge having said handle, said tabs being adjacent said edge having said handle; and, c. means fixed adjacent an edge opposite said edge having said handle for retaining a shirt in a taut posture over said sheet, said means being oriented to open inward toward said edge having said handle.

2. The shirt form of claim 1 further including means for relieving stress on a shirt's underarm seams.

3. The shirt form of claim 2 wherein said stress relieving means is a notch in one of said edges under one of said arm tabs.

4. The shirt form of claim 1 wherein each said arm tab is shaped as an angle having its apex directed outward from said perpendicular edge and in the same plane as said sheet.

5. The shirt form of claim 1 wherein said shirt retaining means comprises at least one clip.

6. The shirt form of claim 5 wherein said clip comprises a fixed portion bound to a face of said sheet and a pivoting portion biased against said face by a spring.

7. The shirt form of claim 6 wherein said pivoting portion further includes a lever bound thereto at a single point, said lever being adapted to be swung outward for added leverage in opening said clip.

8. A shirt lettering and illustrating form comprising, in combination:

a. a stiff, torso-shaped sheet;

b. a neck-shaped projection from an upper edge of said sheet adapted to act as a handle;

c. a pair of arm tabs projecting from opposing lateral edges of said sheet; and, d. means adjacent a lower edge of said sheet for retaining a shirt in a taut posture over said sheet.

9. The shirt form of claim 8 further including means below one of said arm tabs for relieving stress on a shirt's underarm seams.

10. The shirt form of claim 9 wherein said stress relieving means is a notch in one of said lateral edges.

11. The shirt form of claim 8 wherein each said arm tab is shaped as an angle having its apex directed outward from one of said lateral edges in the same plane as said sheet.

12. The shirt form of claim 8 wherein said shirt retaining means comprises at least one clip.

13. The shirt form of claim 12 wherein said clip comprises a fixed portion bound to a face of said sheet and a pivoting portion biased against said face by a spring.

14. The shirt form of claim 13 wherein said pivoting portion further includes a lever bound thereto, said lever being adapted to be swung outward for added leverage in opening said clip.

15. A shirt lettering and illustrating form comprising, in combination:

a. a stiff, torso-shaped sheet having upper and lower edges, a pair of longitudinal side edges, and front and rear faces;

b. a pair of shoulder area supports projecting outward from said side edges adjacent said upper edge; and, c. at least one clip disposed upon said front face, at its lower edge, and oriented to open inwardly toward the longitudinal direction of said sheet.

16. The shirt form of claim 15 further including means below one of said shoulder area supports for relieving stress on a shirt's underarm seams.

17. The shirt form of claim 16 wherein said stress relieving means is a notch in one of said side edges.

18. The shirt form of claim 15 wherein each said shoulder area support is shaped as an angle having its apex directed outward from said side edge and in the same plane as said sheet.

19. The shirt form of claim 15 wherein each said clip comprises at least one fixed portion disposed upon said front face and at least one pivoting portion biased against said face.

20. The shirt form of claim 19 wherein each said clip further includes extensible means for increasing leverage available for opening same.

21. The shirt form of claim 15 wherein said upper edge further includes a handle.

22. The shirt form of claim 21 wherein said handle comprises a slot disposed in said upper edge of said sheet.

23. The shirt form of claim 15 wherein said rear face is substantially planar.

24. A form for lettering and illustrating shirts comprising, in combination:

a. a stiff, generally rectangular sheet, one edge of said sheet having a handle projecting therefrom;

b. an arm tab projecting from each of two edges perpendicular to said edge having said handle, said tabs being adjacent said edge having aid handle; and, c. means fixed adjacent an edge opposite said edge having said handle for retaining a shirt in a taut posture over said sheet.

25. The shirt form of claim 24 further including means for relieving stress on a shirt's underarm seams.

26. The shirt form of claim 25 wherein said stress relieving means is a notch in one of said edges under one of said arm tabs.

27. The shirt form of claim 24 wherein each said arm tab is shaped as an angle having its apex directed outward from said perpendicular edge and in the same plane as said sheet.

28. The shirt form of claim 24 wherein said shirt retaining means comprises at least one clip.

29. The shirt form of claim 28 wherein said clip comprises a fixed portion bound to a face of said sheet and a pivoting portion biased against said face by a spring.

30. The shirt form of claim 29 wherein said pivoting portion further includes a lever bound thereto at a single point, said lever being adapted to be swung outward for added leverage in opening said clip.

* * * * *